US009228418B2

(12) United States Patent
Badri et al.

(10) Patent No.: US 9,228,418 B2
(45) Date of Patent: Jan. 5, 2016

(54) WAVE STIMULATION

(71) Applicant: SCHLUMBERGER TECHNOLOGY CORPORATION, Sugar Land, TX (US)

(72) Inventors: Mohammed Badri, Al-Khobar (SA); Reza Taherian, Al-Khobar (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 394 days.

(21) Appl. No.: 13/711,212

(22) Filed: Dec. 11, 2012

(65) Prior Publication Data

US 2013/0153211 A1 Jun. 20, 2013

Related U.S. Application Data

(60) Provisional application No. 61/570,650, filed on Dec. 14, 2011.

(51) Int. Cl.
*E21B 28/00* (2006.01)
*E21B 43/00* (2006.01)

(52) U.S. Cl.
CPC ..... *E21B 43/003* (2013.01); *E21B 28/00* (2013.01)

(58) Field of Classification Search
CPC ..... E21B 28/00; E21B 43/003
See application file for complete search history.

(56) References Cited

U.S. PATENT DOCUMENTS

| | | | | |
|---|---|---|---|---|
| 4,648,478 | A | 3/1987 | Dedole et al. | |
| 4,702,343 | A | 10/1987 | Paulsson | |
| 4,932,003 | A * | 6/1990 | Winbow et al. | 367/75 |
| 5,115,880 | A | 5/1992 | Sallas et al. | |
| 5,159,160 | A * | 10/1992 | Brett | 181/106 |
| 5,229,554 | A | 7/1993 | Cole | |
| 5,309,405 | A * | 5/1994 | Brett et al. | 367/36 |
| 5,893,383 | A | 4/1999 | Facteau | |
| 6,015,010 | A | 1/2000 | Kostrov | |
| 6,059,031 | A * | 5/2000 | Brett | 166/249 |
| 6,179,084 | B1 | 1/2001 | Yamamoto et al. | |
| 6,247,533 | B1 * | 6/2001 | Brett | 166/65.1 |
| 6,321,836 | B2 | 11/2001 | Brett | |
| 6,550,534 | B2 | 4/2003 | Brett | |
| 7,182,170 | B1 | 2/2007 | Brett et al. | |
| 2011/0094732 | A1 * | 4/2011 | Lehman et al. | 166/249 |

FOREIGN PATENT DOCUMENTS

| | | |
|---|---|---|
| WO | 0140623 | 6/2001 |
| WO | 2007100352 | 9/2007 |

OTHER PUBLICATIONS

International Search Report and Written Opinion of PCT Application No. PCT/US2012/069353 (IS111053WO) dated Mar. 28, 2013: pp. 1-11.

"EOR Through Ultrasound—System Overview," Progress Ultrasonics AG, 2010: pp. 1-3.

Westermark et al., "SPE 67303: Enhanced Oil Recovery with Downhole Vibration Stimulation," SPE International, 2001: pp. 1-13.

* cited by examiner

*Primary Examiner* — William P Neuder
(74) *Attorney, Agent, or Firm* — Bridget M. Laffey; Jakub Michna; Daniel S. Matthews

(57) ABSTRACT

According to some embodiments, a borehole deployable apparatus is described that can be used to generate strong vibrations in a subterranean rock formation. In some embodiments, the apparatus accelerates a mass using mechanisms built into the tool and causes the mass to strike the borehole wall. The mechanisms can control the mass acceleration, and the frequency of strikes. In some embodiments, the apparatus is designed for use in the field of petroleum recovery where the vibrations are used to create or re-establish a flow rate for the fluids in the formation.

32 Claims, 8 Drawing Sheets

WAVE STIMULATION

CROSS REFERENCE TO RELATED APPLICATIONS

This application claims the benefit of U.S. Provisional Patent Application Ser. No. 61/570,650 filed Dec. 14, 2011, the contents of which are incorporated herein by reference in its entirety.

FIELD

This patent specification generally relates to the field of wave stimulation in subterranean rock formations. This patent specification relates more specifically to the generation of vibrations in the formation using tools positioned within a borehole.

BACKGROUND

Wave stimulation is a known technique for enhancing oil recovery from oil-bearing formations. For example, known techniques include generating shock waves by releasing a compressed liquid or by fluidic oscillation within the borehole. Strong vibrations are known to cause oil droplets to coalesce and form larger bulbs of oil that can move and be produced. These vibrations may also change the wettability of the rock. These effects can help increase fluid production from oil wells.

SUMMARY

This summary is provided to introduce a selection of concepts that are further described below in the detailed description. This summary is not intended to identify key or essential features of the claimed subject matter, nor intended to be used as an aid in limiting the scope of the claimed subject matter.

According to some embodiments, a system is described for generating vibrations in a subterranean rock formation. The system includes: a tool body adapted to be deployable in a wellbore; a translatable mass member mounted to the tool body such that the mass member is able to translate along a first direction towards an interior surface of the wellbore when the tool body is deployed in the wellbore; a contacting surface oriented to contact the interior surface of a wellbore (e.g., either the borehole wall or a casing); and an actuator subsystem mounted within the tool body and fixed to the mass member and configured to translationally accelerate in said first direction towards the interior surface of the wellbore such that the contacting surface imparts energy into the interior surface of the wellbore when the tool body is deployed in the wellbore thereby generating vibrations within a subterranean rock formation surrounding the wellbore so as to stimulate production from the formation.

According to some embodiments, the subterranean rock formation is hydrocarbon bearing, and the flow of a hydrocarbon bearing fluid is improved by the generated vibrations in the formation, for example by facilitating coalescence of oil droplets into larger bulbs and/or altering wettability of surfaces within the rock formation. According to some embodiments the actuator subsystem uses one or more pistons to convert gas or hydraulic pressure into motion of the mass member. According to some other embodiments an electric motor can be used in the actuator subsystem.

According to some embodiments, the contacting surface is configured to strike the interior surface of the wellbore and the contacting surface forms part of the translatable mass member. According to some other embodiments, the contacting surface is on a contacting mass member that is separate from the translatable mass member; and the translatable mass member strikes the contacting mass member.

According to some embodiments, one or more anchoring members are moveably mounted on the tool body so as to facilitate stable positioning of the tool body within the wellbore when the mass member strikes the interior surface of the wellbore. The contacting surface of the mass member can have a curvature that is substantially the same to an expected curvature of the interior surface of a wellbore. According to some embodiments more than one translatable mass member can be used which can be actuated simultaneously or in sequence. According to some embodiments, the tool body can be configured for short-term application and can be deployed in the wellbore via a wireline cable, coiled tubing, or on a drilling bottom hole assembly during a drilling process.

According to some embodiments a method for generating vibrations in a subterranean rock formation is described. The method includes: deploying a tool body into a wellbore at a depth within the subterranean rock formation; and linearly accelerating a mass member from the tool body such that the mass member translates towards an interior surface of the wellbore so as to cause a contacting surface to impart energy into the interior surface of the wellbore, thereby generating vibrations within the subterranean rock formation According to some embodiments where the tool body is configured for short-term deployment the tool body can be re-positioned at second depth within the wellbore and the accelerating of the mass member can be repeated so as to cause to strike the interior surface of the wellbore at a second location, prior to retrieving the tool body from the wellbore to an above-ground location.

According to some embodiments, the tool body is configured for long-term deployment in the wellbore. In some cases the tool body is configured to be deployed prior to insertion of production tubing within the wellbore, and in other cases the production tubing is removed from the wellbore prior to deploying of the tool body, and the production tubing is reinstalled following deployment of the tool body. According to some embodiments, the tool body is configured for long-term downhole deployment via a slim tool deployment technique.

According to some embodiments, an apparatus is described that can be used to generate strong vibrations in the formation. In some embodiments, the apparatus translationally accelerates a mass using mechanisms built into the tool and causes the mass to strike the borehole wall. The mechanisms can control the mass acceleration, and the frequency of strikes. In some embodiments, the apparatus is designed for use in the field of petroleum recovery where the vibrations are used to create or re-establish a flow pass for the fluids in the formation.

Further features and advantages of the subject disclosure will become more readily apparent from the following detailed description when taken in conjunction with the accompanying drawings.

BRIEF DESCRIPTION OF THE DRAWINGS

The subject disclosure is further described in the detailed description which follows, in reference to the noted plurality of drawings by way of non-limiting examples of embodiments of the subject disclosure, in which like reference numerals represent similar parts throughout the several views of the drawings, and wherein:

FIGS. 2-1, 2-2 and 2-3 show cross sections of an apparatus for generating vibrations for stimulation purposes, according to some embodiments;

FIG. 3-1 shows an apparatus for generating vibrations in which air pressure is converted in to mass motion, according to some embodiments;

FIG. 3-2 shows an apparatus for generating vibrations for stimulation purposes, according to some other embodiments;

DETAILED DESCRIPTION

The particulars shown herein are by way of example and for purposes of illustrative discussion of the embodiments of the subject disclosure only, and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

Figure 1:
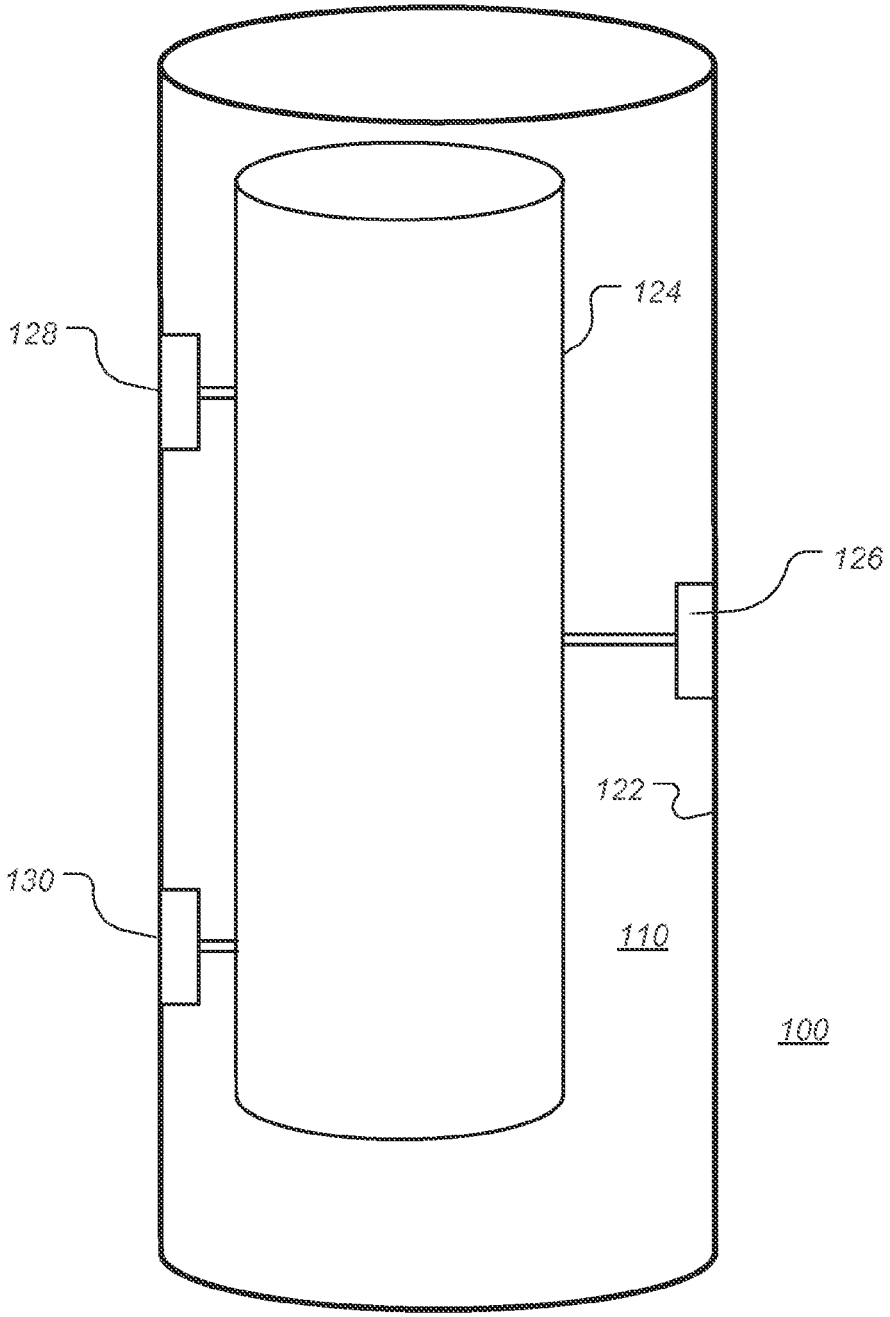
FIG. 1 is a diagram illustrating an apparatus that uses an accelerating mass to strike the borehole wall, thereby generating vibrations in the formation and achieving wave stimulation, according to some embodiments.

As used herein, the terms acoustic wave or vibrations refer to the vibrations induced into the subject formation and may be of frequencies generally referred to as seismic, sonic, or ultrasonic. FIG. 1 is a diagram illustrating an apparatus that uses an accelerating mass to strike the borehole wall, thereby generating acoustic waves in the formation and achieving wave stimulation, according to some embodiments. Tool 124 is shown deployed in a borehole 110 formed within formation 100. A section of borehole wall 122 is shown where tool 124 is disposed at a particular depth. The tool 124 is equipped with a mass 126 that can be projected out of the tool body and strike the borehole wall 122. The tool 124 is also equipped with one or more anchors 128 and 130 to position the tool 124. According to some embodiments, the accelerated mass 126 is a piece of metal projected from the downhole tool 124. The tool 124 has a cylindrical structure, and in some cases more than one mass may be projected from its surface to strike the borehole wall 122.

Figures 1, 2:
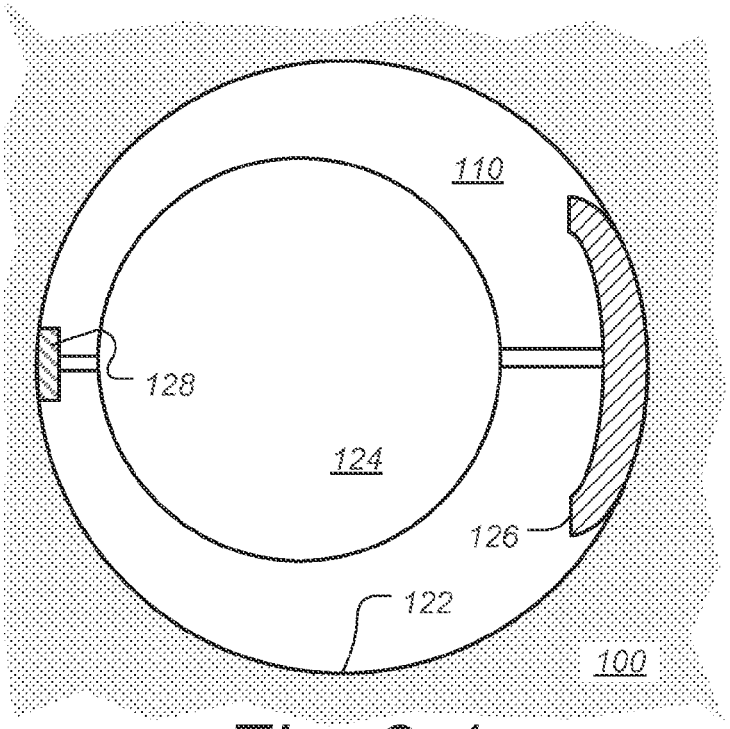
Figure 2:
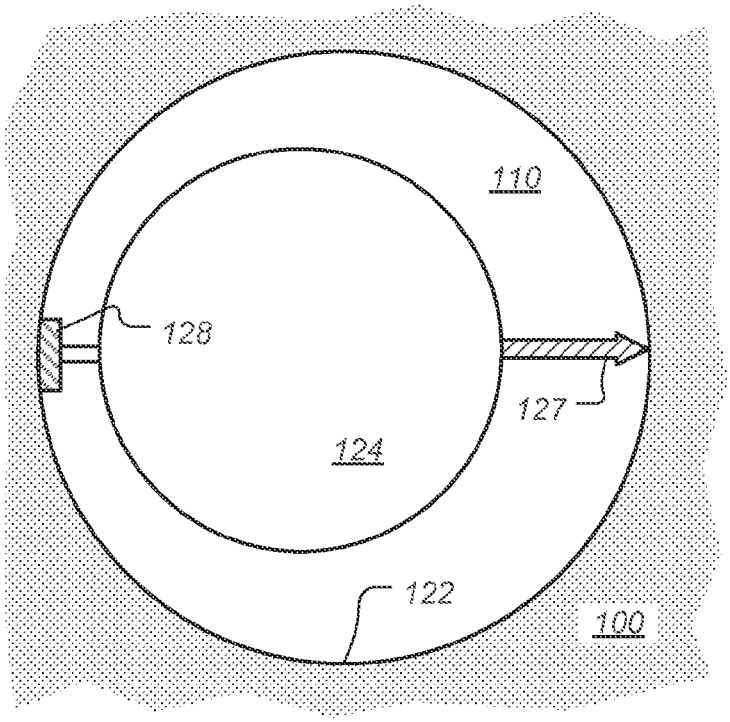
Figures 2, 3:
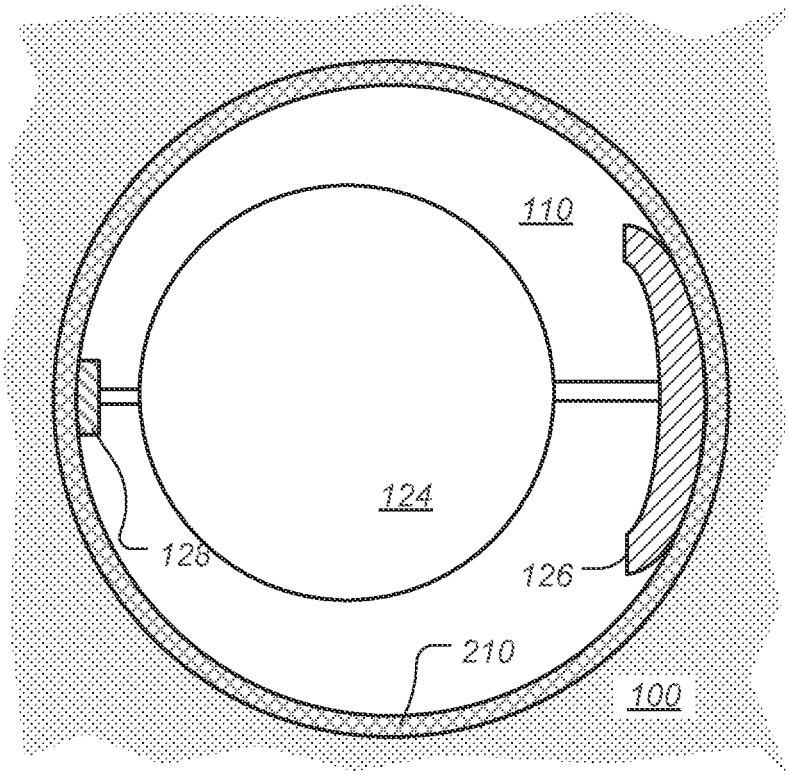
Figures 1, 3:
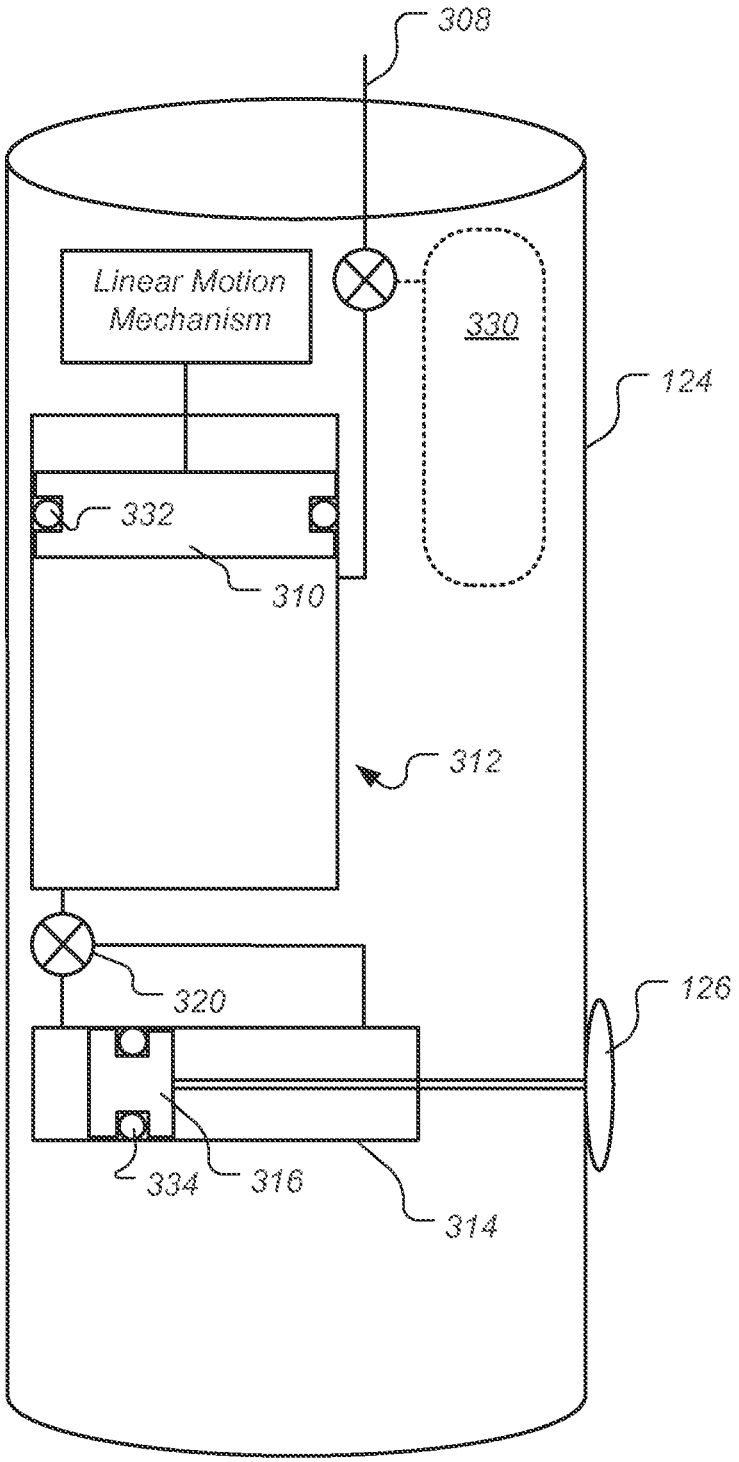
Figures 2, 3:
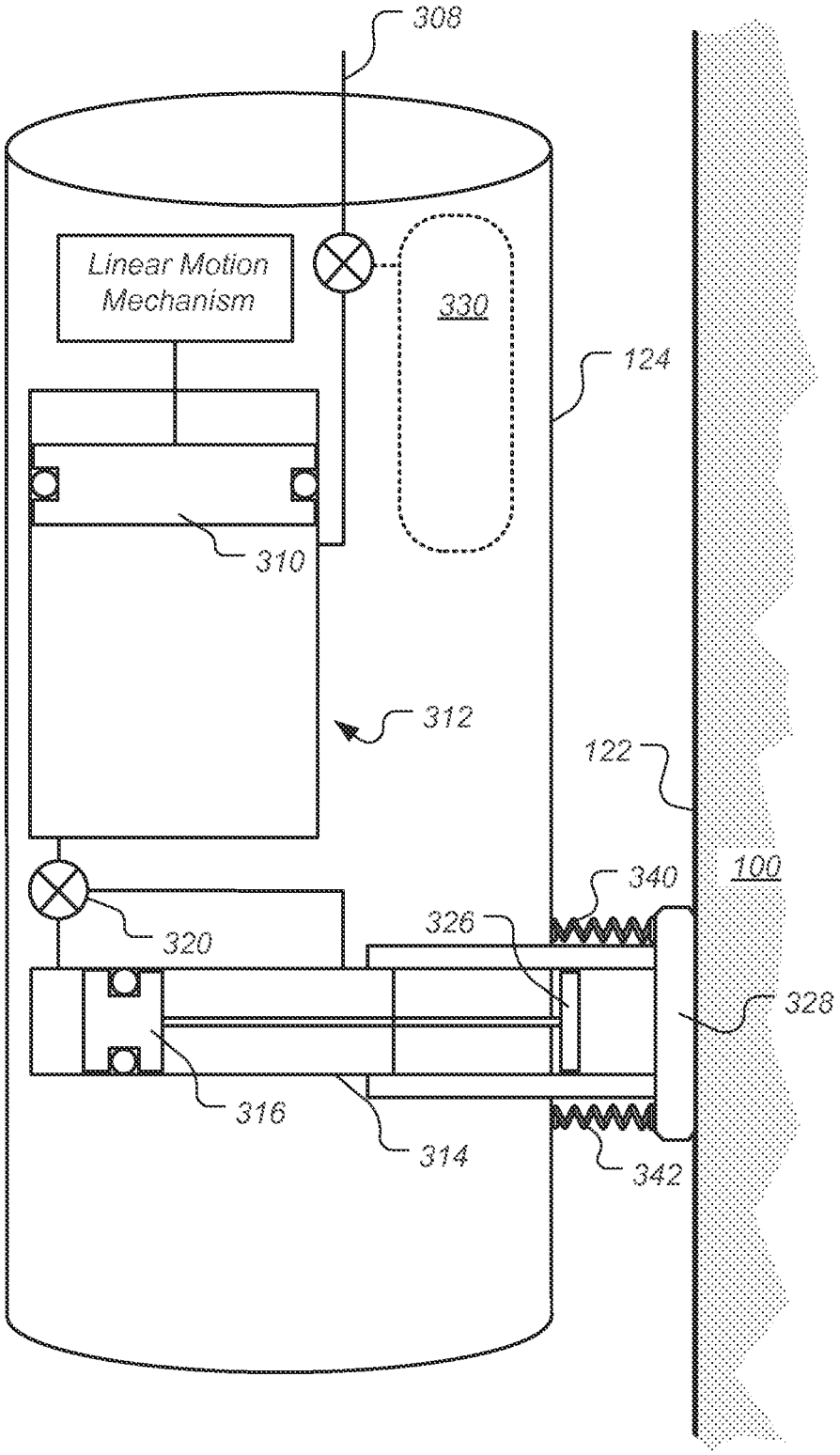

FIGS. 2-1, 2-2 and 2-3 show cross sections of an apparatus for generating acoustic waves for stimulation purposes, according to some embodiments. Tool 124 is shown suspended in borehole 110 having borehole wall 100. In the case of FIG. 2-1, when the mass 126 strikes the borehole wall 122, the force associated with the mass 126 and its acceleration is partially transferred to the formation 100 creating an acoustic wave traveling in the formation 100. The area of the strike zone depends on the surface area of the mass 126 and the curvature of the mass 126 relative to that of the borehole wall 122. The shape of mass surface 126 may be chosen to have substantially the same curvature as the borehole wall 122 if maximum area of acoustic excitation is desired.

When the area is reduced the exerting force is concentrated in a small area and can generate higher-pressure waves in the formation 100. In an extreme case, when the mass surface is reduced to a point, such as shown by mass 127 in the example of FIG. 2-2, the borehole wall 122 can be indented or permanently damaged. The damage can lead to perforation or microcracks in the rock structure for formation 100. According to some embodiments, both of the cases (shown in FIG. 2-1 and FIG. 2-2) have useful applications in the field of oil well production. FIG. 2-3 shows a case where the stimulation tool 124 is being deployed in a region of borehole 110 that is cased with a casing 210. In such embodiments, the mass 126 can strike the casing 210 transmitting some of the vibrations to the formation 100 immediately behind the casing 210. Some of the energy will also be transmitted through the casing 210 and excite areas of formation 100 above and below the strike point depth shown in FIG. 2-3.

According to some embodiments, the mechanism of projecting the mass towards the borehole wall can use air (or other gas), liquid (hydraulic), or an electric motor. In the case where air is used, it is provided from the earth surface according to some embodiments. FIG. 3-1 shows an apparatus for generating acoustic waves in which air pressure is converted in to mass motion, according to some embodiments. In the embodiments of FIG. 3-1, a cylinder 312 having an inner cross sectional area=A1 is equipped with a piston 310, and is located inside the tool 124. An O-ring 332 is positioned within a groove of piston 310 as shown to form a seal with the inner wall of cylinder 310. The cylinder 310 is filled with air to a pressure P1. The piston 310 is compressed to increase the pressure inside the piston to a pressure P2>=P1. Those skilled in the art will recognize that this structure is a so-called accumulator. Depending on the available air pressure there may or may not be a need for the accumulator. Once the desired pressure P2 is reached a three way valve 320 is opened to deliver the pressurized air to a second cylinder 314 having a second piston 316 with cross sectional area A2<A1. As in the case of piston 310, piston 316 has an O-ring 334 for sealing. The rush of air into the second cylinder accelerates the second piston to a linear motion. The second piston is directly or indirectly connected to the mass 126, which is then projected out of the tool body and strikes the borehole wall (not shown). If the second piston 316 is not directly connected to the mass 126, the piston 316 can be arranged to strike the back of the mass 126, which is of interest in some applications.

Note that valve 320 can be used to reciprocate the mass for the next cycle. As a result, in this embodiment, valve 320 is an important component that controls the frequencies achievable by the described apparatus.

According to some embodiments, the gas source is on the surface, and the gas is supplied via a gas supply tube 308. When the source of compressed air (or other gas) is at the surface, the tool can be made simpler than the case where the source is downhole. The drawback, however, is that one has to have high pressure tube 308 running along the length of the well. According to some embodiments, an alternative approach provides an air tank and a pump within the tool. In this case, the gas supply tube 308 runs to another section of the tool string where the tank and pump are positioned (not shown).

According to some embodiments, other fluids, such as hydraulic fluid for example, can also be used for driving the piston and the mass, instead of air. In this case, a small reservoir of hydraulic fluid 330 is provided in the tool and there is no need for high pressure tubing to run along the length of the well, unless that is desired.

FIG. 3-2 shows an apparatus for generating vibrations for stimulation purposes, according to some other embodiments. In this case the mass 328 is applied to the borehole wall 122 using springs 340 and 342, which are independent of the second piston 316. The second piston 316 in this case is fixed to an intermediate mass 326. The piston 316 accelerates mass 326 to strike mass 328, thereby imparting energy into mass 328 to generate waves in formation 100. The arrangement as shown in FIG. 3-2 has been found to help to stabilize the tool 124 within the borehole.

It has been found that by linearly accelerating the moving mass (e.g., mass 126 or mass 326) such that it translates towards the borehole wall, such as shown and described herein can generate relatively large amplitude vibrations within the surrounding formation. The amplitudes are significantly greater than can be generated by other techniques such as by rotating or whirling a mass in a circular motion or by bending or distorting a mass such as by piezoelectric bending actuators.

Figure 4:
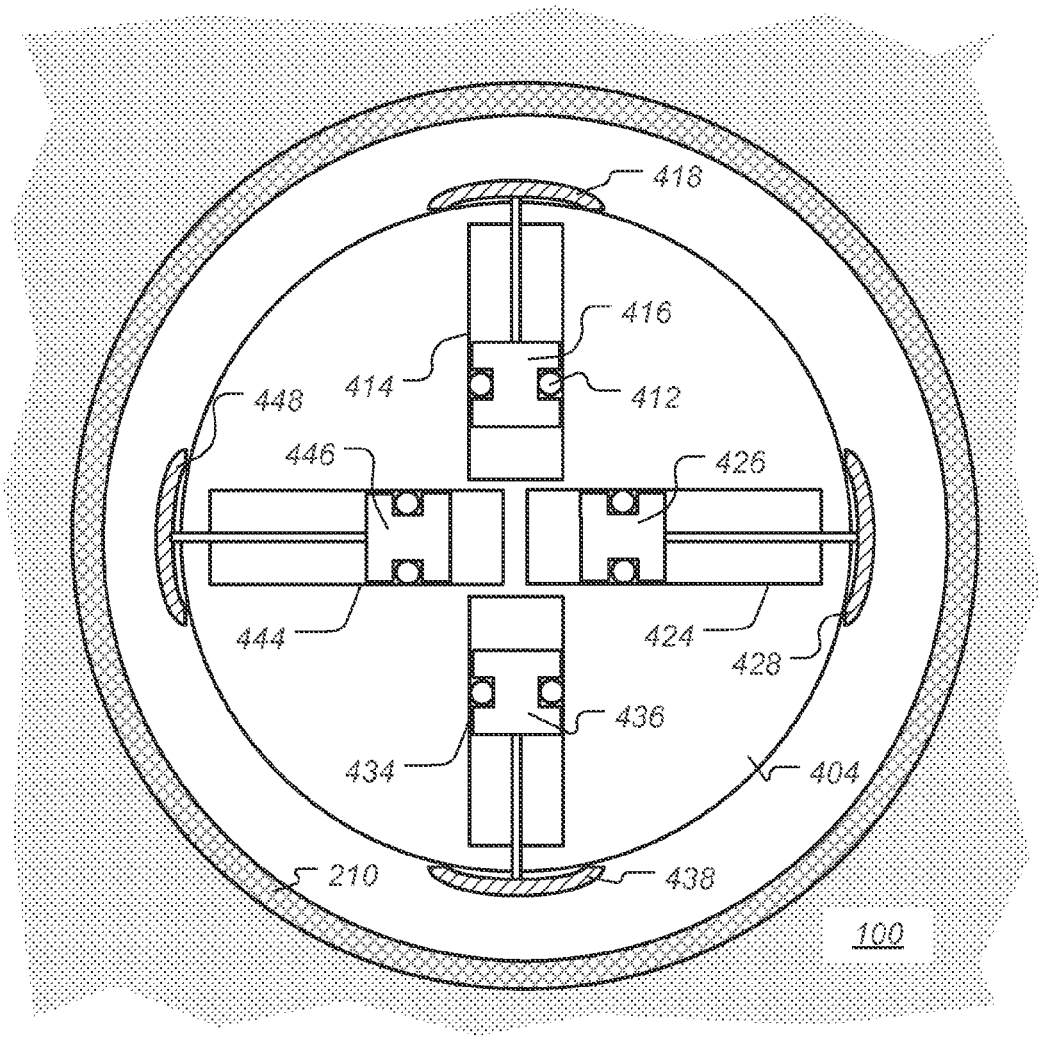
FIG. 4 is a cross-section of an apparatus for generating vibrations for stimulation purposes, according to some embodiments.

FIG. 4 is a cross-section of an apparatus for generating vibrations for stimulation purposes, according to some embodiments. In the case shown in FIG. 4, symmetrically placed pistons are used to drive masses in different directions. The driving can be done simultaneously or in sequence. In the example of FIG. 4, four pistons are used, although other numbers of pistons can be used according to other embodiments.

FIG. 4 is a cross sectional view of the tool 404 at the level of cylinders 414, 424, 434 and 444. Cylinder 414 houses piston 416 that applies force to mass 418. An O-ring 412 sits within a groove of piston 416 to form a seal with the cylinder 414. Similarly, cylinders 424, 434 and 444 house pistons 426, 436 and 446 respectively, which apply force to masses 428, 438 and 448 respectively. For clarity, the mechanism and the plumbing by which the pressurizing fluid is connected to the pistons are not shown, but it is similar or identical to that shown in FIG. 3-1, according to some embodiments. As the pressurizing fluid enters the four cylinders 414, 424, 434 and 444, it pushes the pistons 416, 426, 436 and 446 outward which in turn causes masses 418, 428, 438 and 448 to accelerate and strike the borehole wall (in cases where the borehole is uncased at the location of the tool) or strike the casing 210 (in cases where the borehole is cased at the location of the tool).

Figure 5:
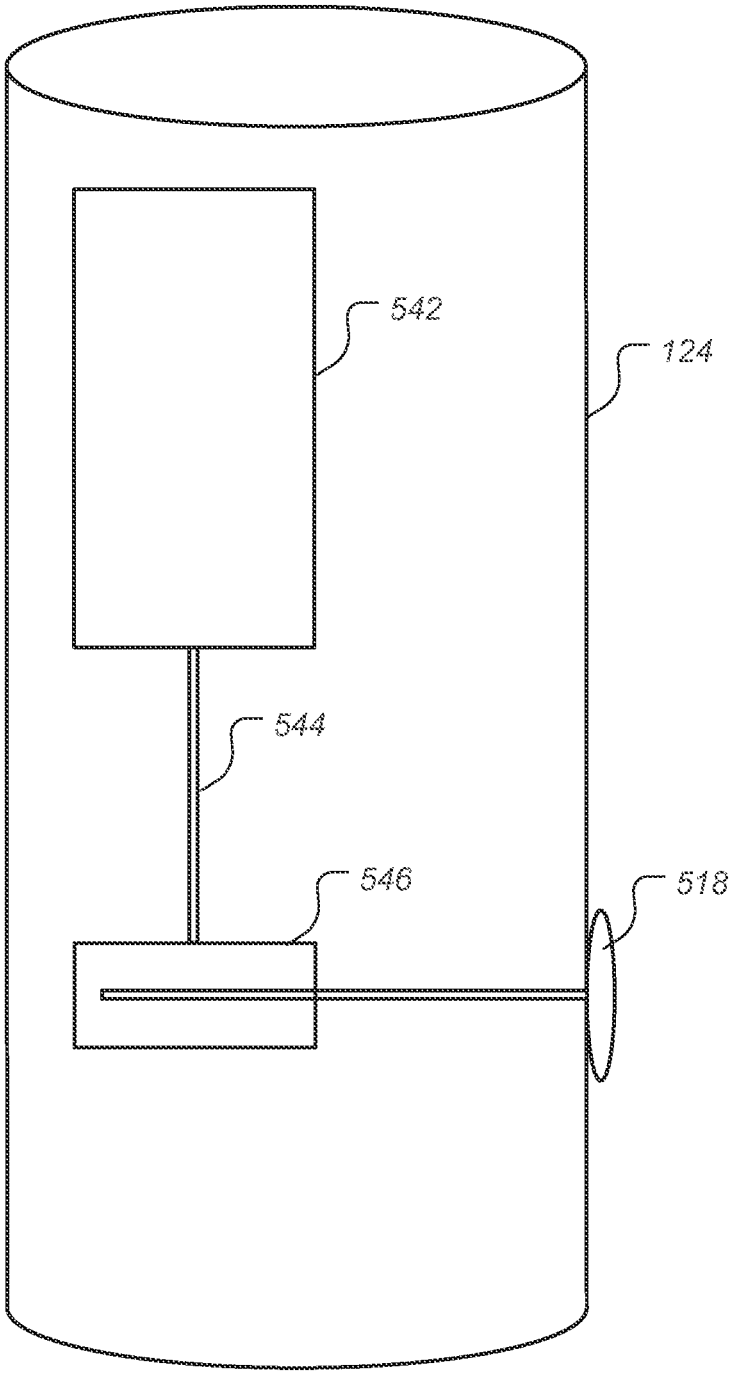
FIG. 5 shows an apparatus for generating vibrations in which an electric motor is used to move a mass for striking a borehole wall, according to some embodiments.

FIG. 5 shows an apparatus for generating vibrations in which an electric motor is used to move a mass for striking a borehole wall, according to some embodiments. According to some embodiments, a gearbox is used between the motor and the mass to control the velocity of the mass and the amount of energy imparted to the formation. In the embodiment shown in FIG. 5, the tool 124 includes electric motor 542 that rotates the vertical shaft 544, which is connected to the gear box 546. The gear box 546 in this case transforms the rotational motion of shaft 544 to the translational motion of mass 518 which in turn strikes the borehole wall and generates acoustic vibrations in the formation.

Figure 6:
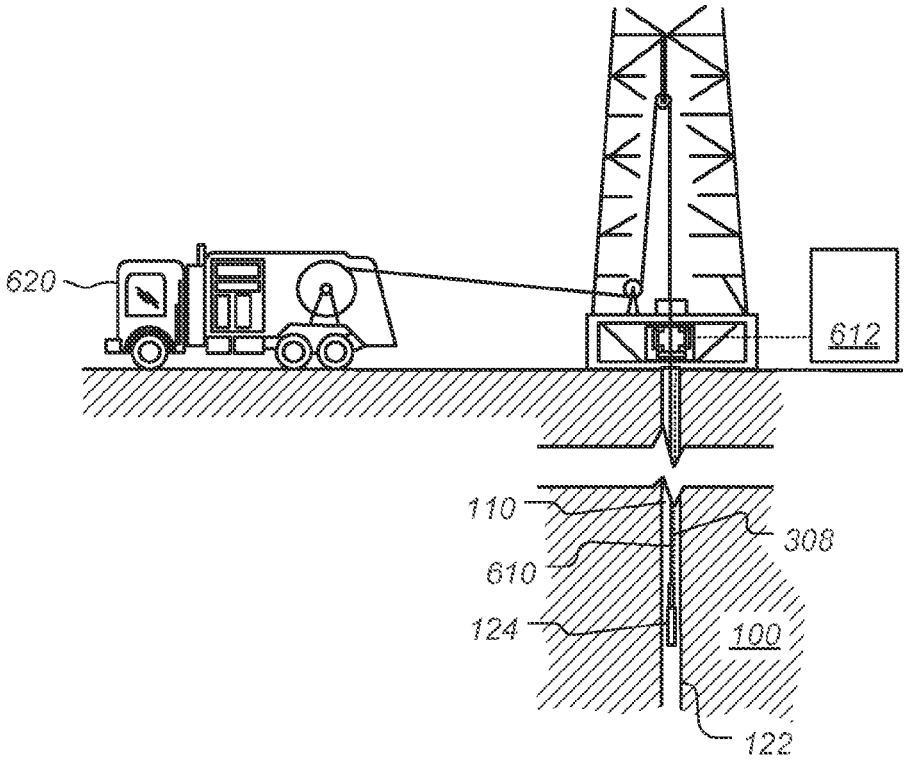
FIG. 6 shows a wellsite in which a borehole tool is being deployed for generating vibrations in a subterranean formation for stimulation purposes, according to some embodiments.

FIG. 6 shows a wellsite in which a borehole tool is being deployed for generating vibrations in a subterranean formation for stimulation purposes, according to some embodiments. Shown is a stimulation tool 124 being deployed in a borehole 110 formed within subterranean rock formation 100. In the case shown in FIG. 6, the tool 124 is being deployed in borehole 110 via a wireline 610 from wireline truck 620. However, according to some embodiments, the mode of deploying the stimulation tool 124 depends on a number of factors including the life of the well and whether it is horizontal or vertical well. The stimulation tool 124 can be deployed using other technologies such as for example using coiled tubing, or during a drilling operation on a bottom hole assembly. According to some embodiments, as described hereinabove, an air compressor 612 can be used and connected to the tool 124 via gas tube 308.

According to some embodiments, the tool 124 can be deployed for either short-term application or long-term application. In an example of short-term application, the tool 124 is deployed in the well 110 which has just been cased. According to some embodiments, the wellbore 110 in the region of interest of formation 100 can have open hole completion, where there is direct access to the formation and the mass can strike the formation directly.

According to some other embodiments, the wellbore 110 in the region of interest of formation 100 can be cased with perforations. In this case the mass (or masses) of tool 124 can strike the casing, which then transmits some of the vibrations to the formation immediately behind the casing. Some of the energy will be transmitted through the pipe and excite areas above and below the strike point.

In an example of a long-term application, according to some embodiments, the tool 124 may be deployed before the production pipes are installed. In this case the connections to the tool for power, control, and possibly compressed air can go through a pipe. According to other long-term application embodiments, the well 110 is already completed and is producing, then the production pipes are removed and tool 124 is deployed, followed by a re-installation of the production pipes. According to yet other long-term application embodiments, the well 110 is already completed and is producing, then depending on the inner diameter of the pipe, a slim version of the tool 124 can be deployed.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A system for generating vibrations in a subterranean rock formation, the system comprising:

a tool body adapted to be deployable in a wellbore;

a translatable mass member mounted to the tool body such that the mass member is able to translate along a first direction towards an interior surface of the wellbore when the tool body is deployed in the wellbore;

a contacting surface oriented to contact the interior surface of a wellbore;

an actuator subsystem mounted within the tool body and fixed to the mass member and configured to translationally accelerate in said first direction towards the interior surface of the wellbore such that the contacting surface imparts energy into the interior surface of the wellbore when the tool body is deployed in the wellbore thereby generating vibrations within a subterranean rock formation surrounding the wellbore so as to stimulate production from the formation; and a second translatable mass member mounted within the tool body and having a contacting surface oriented with respect to the tool body to strike a second interior surface of the wellbore when the tool body is deployed in the wellbore.

2. A system according to claim 1 wherein the generated vibrations within the formation facilitate stimulation of production from the formation.

3. A system according to claim 1 wherein the contacting surface forms part of the translatable mass member, and the contacting surface strikes the interior surface of the wellbore.

4. A system according to claim 1 wherein the contacting surface is on a contacting mass member that is separate from the translatable mass member; and the translatable mass member strikes the contacting mass member.

5. A system according to claim 4 wherein the contacting mass member is held in contact with the interior surface of the wellbore using one or more spring members, to facilitate stabilizing of the tool body within the wellbore when deployed therein.

6. A system according to claim 1 wherein the subterranean rock formation is a hydrocarbon bearing rock formation and a flow of a hydrocarbon bearing fluid is improved by the generated vibrations in the formation.

7. A system according to claim 1 wherein the actuator subsystem converts gas pressure into motion of the mass member.

8. A system according to claim 7 wherein the actuator subsystem includes a piston and a valve to convert gas pressure into motion of the mass member.

9. A system according to claim 8 further comprising a gas compressor at an above-ground position and a gas supply tube in gas communication with the gas compressor and the actuator subsystem.

10. A system according to claim 8 further comprising a gas tank and gas pump within the tool body, and being in gas communication with the piston in the actuator subsystem.

11. A system according to claim 8 wherein the actuator subsystem further includes an accumulator for increasing gas pressure.

12. A system according to claim 7 wherein the gas is air.

13. A system according to claim 1 wherein the actuator subsystem converts hydraulic pressure into motion of the mass member.

14. A system according to claim 1 wherein the actuator subsystem includes an electric motor for converting electrical energy into motion of the mass member.

15. A system according to claim 1 further comprising one or more anchoring members moveably mounted on the tool body so as to facilitate stable positioning of the tool body within the wellbore when the mass member strikes the interior surface of the wellbore.

16. A system according to claim 1 wherein the contacting surface of the mass member has a curvature that is substantially the same to an expected curvature of the interior surface of a wellbore.

17. A system according to claim 1 wherein the translatable mass and the second translatable mass are mounted symmetrically about a central axis of the tool body.

18. A system according to claim 1 wherein the tool body is configured to be deployed in the wellbore using a technique selected from a group consisting of: on a wireline cable, via coiled tubing, and on a drill pipe.

19. A system according to claim 1 wherein the interior surface of the wellbore is of a type selected from a group consisting of: a borehole wall surface and a borehole casing surface.

20. A method for generating vibrations in a subterranean rock formation, the method comprising:

deploying a tool body into a wellbore at a depth within the subterranean rock formation;

linearly accelerating a mass member from the tool body such that the mass member translates towards an interior surface of the wellbore so as to cause a contacting surface to impart energy into the interior surface of the wellbore, thereby generating vibrations within the subterranean rock formation; and linearly accelerating a second mass member such that the second mass member translates towards a second interior surface of the wellbore so as cause the second mass member to strike the second interior surface of the wellbore.

21. A method according to claim 20 wherein the generated vibrations within the formation stimulates fluid production from the formation.

22. A method according to claim 20 wherein the contacting surface forms part of the mass member, and the contacting surface strikes the interior surface of the wellbore.

23. A method according to claim 20 wherein the contacting surface is on a contacting mass member that is separate from the mass member, and the accelerated mass member strikes the contacting mass member thereby imparting kinetic energy into the contacting mass member.

24. A method according to claim 20 wherein the subterranean rock formation is a hydrocarbon bearing rock formation and a flow of a hydrocarbon bearing fluid is improved by the generated vibrations in the formation.

25. A method according to claim 24 wherein the vibrations facilitate coalescence of oil droplets into larger bubbles and/or facilitate altering wettability of surfaces within the rock formation thereby improving flow of the hydrocarbon bearing fluid.

26. A method according to claim 20 wherein the tool body is configured for short-term deployment in the wellbore.

27. A method according to claim 24 further comprising:

re-positioning the tool body to a second depth within the wellbore and repeating the accelerating of the mass member so as to cause the contacting surface of the mass member to strike the interior surface of the wellbore at a second location; and retrieving the tool body from the wellbore to an above-ground location.

28. A method according to claim 20 wherein the tool body is configured for long-term downhole deployment and wherein said deploying of the tool body occurs prior to insertion of a production tubing within the wellbore.

29. A method according to claim 20 wherein the tool body is configured for long-term downhole deployment and wherein production tubing is removed from the wellbore at said depth prior to said deploying of the tool body, and the production tubing is reinstalled following deployment of the tool body.

30. A method according to claim 20 wherein the tool body is configured for long-term downhole deployment via a slim tool deployment technique.

31. A method according to claim 20 wherein said accelerating of the mass and the second mass occur simultaneously.

32. A method according to claim 20 wherein said accelerating of the mass and the second mass are offset by a predetermined time interval.

* * * * *